United States Patent [19]

Witczak

[11] Patent Number: 4,802,411

[45] Date of Patent: Feb. 7, 1989

[54] ADJUSTABLE MOUNTING BRACKET FOR PRINTING OR DUPLICATING MACHINE

[75] Inventor: Stanley Witczak, Chicago, Ill.

[73] Assignee: AM International, Inc., Chicago, Ill.

[21] Appl. No.: 11,568

[22] Filed: Feb. 6, 1987

[51] Int. Cl.[4] ..... B41F 5/00

[52] U.S. Cl. ..... 101/216; 100/168; 101/247; 101/348; 101/350

[58] Field of Search ..... 101/348, 349, 352, 216, 101/218, 350, 247; 100/168

[56] References Cited

U.S. PATENT DOCUMENTS

| | | | |
|---|---|---|---|
| 2,474,160 | 6/1949 | Peyrebrune | 101/348 |
| 3,259,060 | 7/1966 | Martin | 101/348 |
| 3,276,362 | 10/1966 | Grünig | 101/348 X |
| 3,366,047 | 1/1968 | Hermach et al. | 101/348 X |
| 3,625,148 | 12/1971 | Muselik et al. | 101/348 |
| 4,080,895 | 3/1978 | Liska | 101/218 |

*Primary Examiner*—Edgar S. Burr
*Assistant Examiner*—Moshe I. Cohen
*Attorney, Agent, or Firm*—Nicholas A. Camasto; John R. Hoffman

[57] ABSTRACT

A bracket assembly for receiving and positionally adjusting the shaft end of a distribution roller in a printing, duplicating or like machine. A pin head structure is mounted on a framework of the machine. A triangular array of pins project inwardly of the pin head axially of the roller for receiving the shaft end of the roller in a position of engagement between the pins. At least one of the pins is adjustable generally in a radial direction to take up any radial play between the roller shaft end and the pin array. At least one of the pins includes means adjustable in an axial direction to take up any axial play between the roller shaft end and the pin head structure. At least one of the pins is retractable to allow for insertion of the roller into position between the pins. The entire pin head structure is rotatable about a given axis generally parallel to and offset from the axis of rotation of the roller to effect movement of the roller bodily in a radial direction relative to an adjacent roller.

18 Claims, 2 Drawing Sheets

ADJUSTABLE MOUNTING BRACKET FOR PRINTING OR DUPLICATING MACHINE

BACKGROUND OF THE INVENTION

This invention generally relates to printing or duplicating machines and, more particularly, to a bracket assembly for receiving and positionally adjusting the shaft end of a form roller in the printing couple of the machine.

Printing machines normally include a printing couple which comprises a number of cylinders and/or rollers such as impression cylinders, master cylinders, blanket cylinders, ductor rollers, transfer rollers, regulator rollers, and the like. For instance, an ink fountain is disposed generally at the rear of the machine for feeding ink to the various rollers of the printing couple which transfers images to copy sheets. In such printing machines as rotary offset lithographic duplicating machines, a moisture fountain also is disposed adjacent the printing couple for feeding moisture to the printing couple. A number of rollers which generally can be termed "distribution" rollers are provided between the ink fountain and/or moisture fountain for distributing ink and/or moisture to the printing couple of the machine.

The distribution rollers conventionally are mounted between spaced side frame plates of the machine framework. Many of the rollers are arranged in triangular arrays, and the rollers define distribution gaps with other adjacent rollers to form flow paths for the ink and/or moisture to the master or plate cylinder. Throughout the complex system of rollers, the "gaps" or pressure between adjacent rollers must be capable of regulation or positional adjustment in order to regulate the flow of ink or moisture through the flow paths of the roller system to the printing couple. The position of the rollers are critical in order to avoid lines or "shadows" on the imaged copy which are caused by uneven distribution of the ink or moisture. For instance, any "play" between the distribution rollers adversely affects the maintenance of proper ink gaps and results in poor copy quality.

Heretofore, roller mounting and adjustment mechanisms have been extremely complicated. Often, the machine must be shut down in order to perform any adjustments. In some instances, one or more of the rollers may have to be removed in order to accomplish any adjustments. This further complicates the construction of the mounting assemblies or brackets for the form rollers.

These problems further are complicated in machines where it may be necessary to separate one or more rollers during down time, such as during overnight periods when the machine is not operating. If two adjacent rollers are maintained in contact during any extended period of time, particularly where the rollers are fabricated of resilient material, set line indentations are created which form lines or shadows on the imaged copy. Therefore, separation or "night latch" mechanisms often are incorporated in the roller system to separate adjacent rollers during down time.

It would be desirable to provide simple, effective and easy to adjust mechanisms and bracket assemblies for positioning the form rollers in a manner to obviate the problems caused by the complex mechanisms described above. This invention is directed to solving the above problems and satisfying such a need for a simple bracket assembly for mounting form rollers in a printing or duplicating machine.

SUMMARY OF THE INVENTION

An object, therefore, of the invention is to provide a new and improved bracket assembly for mounting a form roller in a printing, duplicating or like machine.

Another object of the invention is to provide a system wherein the entire mounting bracket assembly for the roller can be adjusted to separate the roller from one or more adjacent rollers, such as during down time of the machine. chine.

In the exemplary embodiment of the invention, a bracket assembly is provided for receiving and positionally adjusting the shaft end of a form roller in the printing couple of the machine. A pin head structure is mounted on a framework of the machine, such as the inside of a side frame plate. A triangular array of pins project inwardly of the pin head axially of the roller for receiving the shaft end of the roller in a position of engagement between the pins. Means are provided for adjusting at least one of the pins in a radial direction to take up any radial play between the roller shaft end and the pin array. Means are provided for adjusting at least one of the pins in an axial direction to take up any axial play between the roller shaft end and the pin head structure. Means are provided for retracting at least one of the pins to allow for insertion of the roller into position between the pins.

The invention also contemplates the provision of a "night latch" feature including means movably mounting the entire pin head structure on the framework of the machine for moving the form roller bodily in a radial direction relative to a adjacent roller. Specifically, the pin head structure is mounted on the machine framework for rotation about a given axis generally parallel and offset relative to the axis of rotation of the form roller to effect the radial movement of the roller in response to rotation of the pin head structure. A manually operable latch means is provided on the outside of the machine framework, extending through the framework, for selectively rotating the pin head structure to radially move the form roller.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBDODIMENT

Figure 1:
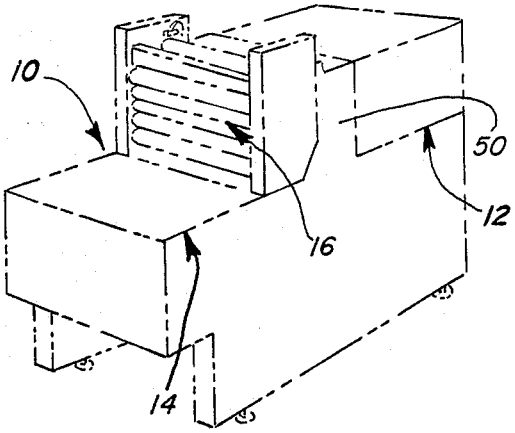
FIG. 1 is a somewhat schematic perspective view of a printing or duplicating machine in which the invention is applicable.

Referring to the drawings in greater detail, and first to FIG. 1, the invention is illustrated herein for use in a printing, duplicating or like machine, generally designated 10, which includes a sheet feeding end, generally designated 12, and an imaged copy exiting end, generally designated 14. The copy sheets which have images produced on one or both sides are stacked at exiting end 14 as is conventional with most printing or duplicating machines. The machine includes at least one printing couple, generally designated 16, which includes the conventional impression cylinders, blanket cylinders and master or plate cylinders. Usually, the printing couple includes one impression cylinder, one blanket cylinder and one master or plate cylinder.

Printing or duplicating machine 10 may be such as a rotary offset lithographic machine which includes an ink fountain for feeding ink to various distribution rollers of the printing couple which transfers images to copy sheets. In addition, a moisture fountain is disposed adjacent the printing couple for feeding moisture to the printing couple through a path defined by the distribution rollers.

Figure 2:
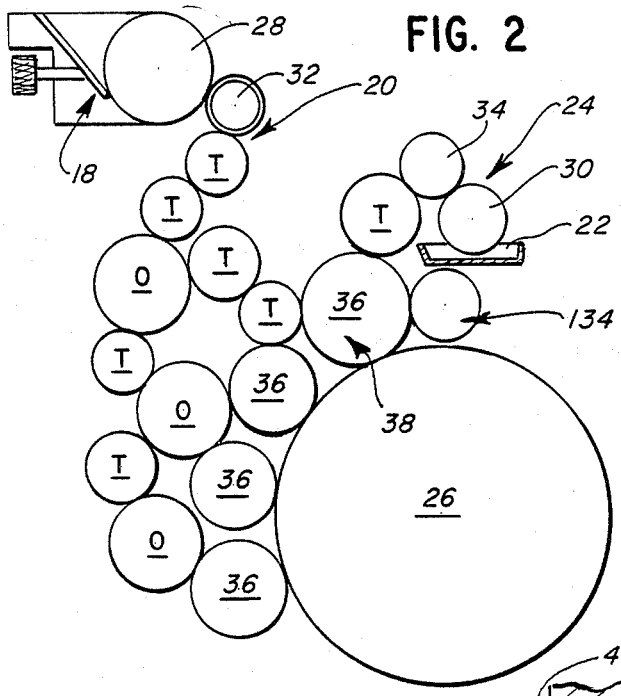
FIG. 2 is a somewhat schematic view of the rollers comprising the system for feeding ink and moisture to the master cylinder of the machine.

More particularly, FIG. 2 illustrates the ink/moisture roller system of the machine for distributing ink from an ink fountain, generally designated 18, through an ink feeding roller system, generally designated 20, and for feeding moisture from a moisture fountain 22 through a moisture feeding roller system, generally designated 24, to a master or plate cylinder 26. An ink fountain roller 28 is rotatable in ink fountain 18, and a moisture roller 30 is rotatable in moisture fountain 22. Pickup rollers 32 and 34 are provided in rolling contact with ink fountain roller 28 and moisture fountain roller 30, respectively.

The ink/moisture distribution system for distributing ink and moisture to master cylinder 26 includes four form rollers 36 in rolling contact with master cylinder 26. A number of transfer rollers and oscillating rollers are provided in the distribution system and, for brevity purposes, have been designated "T" and "0", respectively.

The bracket assembly of this invention is designed for receiving and positionally adjusting the shaft ends of one or more of the rollers in the ink/moisture distribution system described above. Consequently, in the following description and the claims, the general term "form" roller will be used in conjunction with the description of the bracket assembly, it being understood that the bracket assembly is applicable for mounting a variety of different rollers having different functions.

Figure 3:
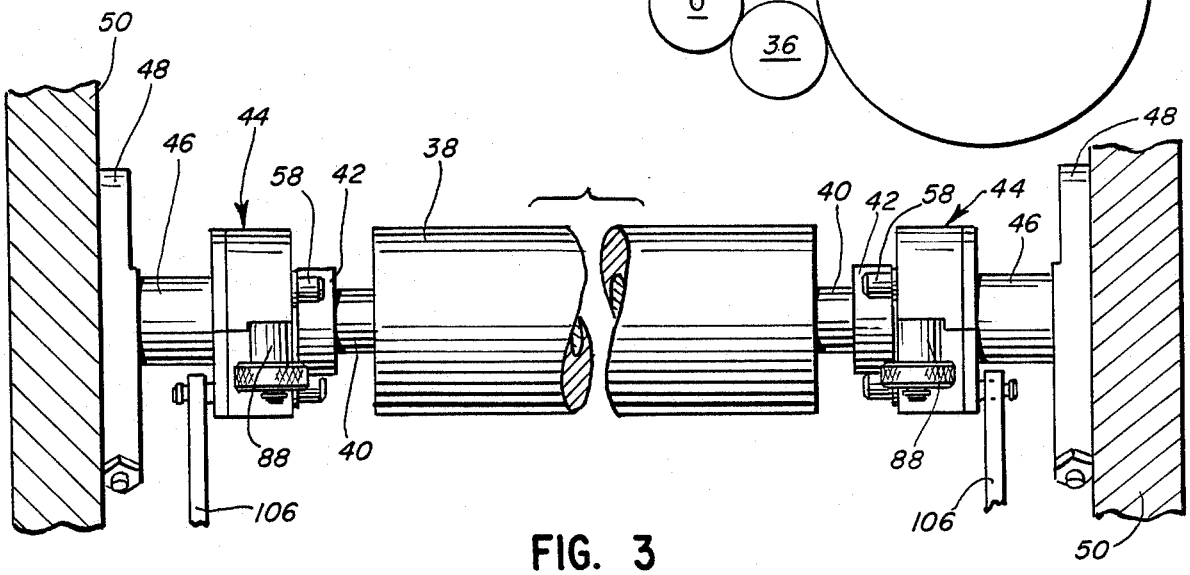
FIG. 3 is a fragmented elevational view of a form roller with the shaft ends thereof mounted by bracket assemblies of this invention.

FIG. 3 shows a form roller 38 (also see FIG. 2) having shaft ends 40 provided with bearings 42. The shaft ends are received and positionally adjusted by means of bracket assemblies, generally designated 44, designed in accordance with the concepts of the invention. Each bracket assembly includes a shaft housing 46 and a mounting plate 48 for mounting the bracket assembly to the inside surface of a side frame plate 50 of the printing or duplicating machine.

Figure 4:
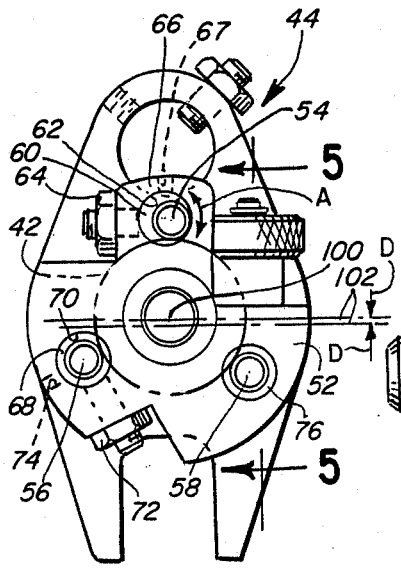
FIG. 4 is an elevational view of the inside of a bracket assembly.

FIGS. 4–7 illustrate the details of each bracket assembly 44. The bracket assembly includes a pin head structure 52 having a triangular array of pins 54,56 and 58 projecting inwardly of the pin head axially of roller 38 for receiving the shaft end of the roller in a position of engagement between the pins. In essence, the pins define receptacle means for the shaft end. As seen in FIG. 4, pins 54–58 actually surround and embrace bearing 42 on roller shaft end 40. However, at times hereinafter the term "shaft end" will be used for brevity purposes to include bearing 42.

Generally, means are provided for adjusting at least one of pins 54–58 in a radial direction to take up any radial play between the roller shaft end and the pin array. Means are provided for adjusting at least one of the pins in an axial direction to take up any axial play between the roller shaft end and the pin head structure. Means are provided for retracting at least one of the pins to allow for insertion of the roller into position between the triangular array of pins. All of these functions of radial adjustment, axial adjustment and roller retraction are accomplished by the simple use of a unitary pin head structure having the triangular array of pins 54–58, with associated adjusting mechanisms between the pins and the pin head itself. No other extraneous mechanisms are provided between the bracket assembly and the machine framework or other extraneous mechanisms.

Figure 6:
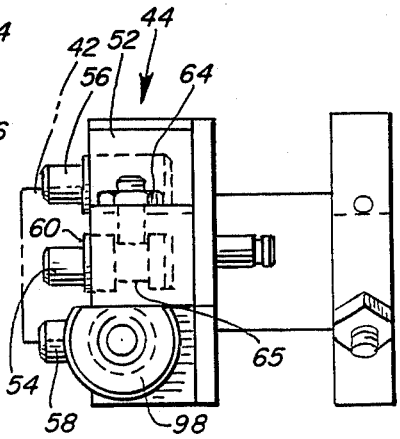
FIG. 6 is a top plan view of the bracket assembly.

More particularly, the means for taking up radial play between the roller (i.e. the roller shaft end) is provided by locating pin 54 eccentric or offset relative to the central axis thereof, as can be seen best in FIG. 4. The pin has an enlarged portion 60 forming a shoulder which actually engages the roller shaft end (i.e. bearing 42). The shoulder slightly projects from pin head 52 as seen in FIG. 6 for engaging the bearing. Enlarged portion 60 of pin 54 is freely rotatable within a bore 62 (FIG. 4) of pin head 52. Therefore, rotation of the pin about its eccentric axis causes the pin to move in the direction of doubleheaded arrow "A", in an arc toward and away from the center of the triangular array of pins. The arc is in a generally radial direction and, therefore, rotation of pin 54 and enlarged portion 60 is effective to take up any radial play between the roller shaft end and the pin, as the roller shaft end seats on pins 56 and 58. A set screw type device 64 is threaded through an ear portion 66 of pin head 52 for engaging enlarged portion 60 to lock pin 54 in any rotatable position of adjustment. The enlarged portion is recessed, as at 65, for engagement therewithin by set screw 64 to prevent the formation of burrs which might jam movement of the pin. A hole 67 may be provided through ear portion 66 for providing access therethrough of an appropriate tool to facilitate manually rotating eccentric, enlarged portion 60 of pin 54 to effect rotational adjustment thereof.

The means for taking up any axial play between the roller shaft end and pin head structure 52 is incorporated in the mechanism mounting pin 56. More particularly, pin 56 also has an enlarged portion 68 forming a shdulder for abutting bearing 42 as the bearing is embraced by the triangular array of pins. Portion 68 is mounted in a bore 70 in pin head 52 for free axial movement within the bore. A set screw type device 72 is threaded through pin head 52 for engaging enlarged portion 68. Therefore, by loosening set screw 72, pin 56 can be moved axially inwardly until the shoulder formed by enlarged portion 68 engages bearing 42, to thereby take up any axial play between the roller shaft end and the pin head structure, i.e. between the bearing and enlarged portion 68. A hole 74 may be formed through pin head 52 for the insertion of an appropriate tool to engage enlarged portion 68 of pin 56 to move the pin axially to take up the necessary play.

The means for retracting one of the pins in order to allow for insertion of roller 38 into position between the triangular array of pins is incorporated in operative association with pin 58. It can be seen in FIG. 4 that pin 58 also has an enlarged portion 76 providing a shoulder for engaging bearing 42. More particularly, referring to FIG. 5, it can be seen that enlarged portion 76 of pin 58 is received in a bore 78 in pin head 52 for free axial movement within the bore. A lock bolt 80 is threaded into a cross bore 82 in pin 58, as at 84, so that the lock bolt is fixed to the pin for axially moving the pin in the direction of double-headed arrow "B". A slot 86 is formed in pin head 52 for accommodating movement of lock bolt 80.

Figure 5:
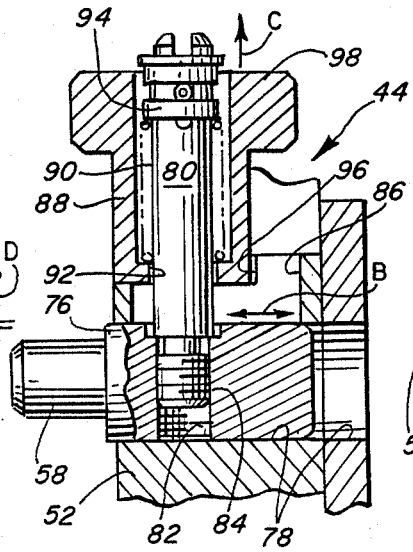
FIG. 5 is a fragmented section, on an enlarged scale, taken generally along line 5—5 of FIG. 4.

A release latch means is provided for holding lock bolt 80 and pin 58 (76) in extended position as shown in FIG. 5, and for allowing movement of the pin into and out of the pin head. Specifically, the latch means include a sleeve 88 surrounding lock bolt 80, with a coil spring 90 sandwiched between a bottom shoulder 92 on the interior of sleeve 88 and an annular flange 94 fixed to lock bolt 80. The base or lower distal end of sleeve 88 is biased by spring 90 into a recess 96 formed in pin head 52. This holds pin 58 in its extended position. By pulling on sleeve 88, through an enlarged finger-grasping portion 98 thereof, in the direction of arrow "C" (FIG. 5), the sleeve is pulled out of recess 96 to allow movement of lock bolt 80 in slot 86 and pin 58 (76) in bore 78. This enables pin 58 to be retracted substantially into pin head 52 and thereby allow for insertion of roller 38 with its shaft end (i.e. bearing 42) into position between pins 54–58.

As stated above, a feature of the invention contemplates means for movably mounting the entire pin head structure 52 on the framework (i.e. frame plates 50) of the machine for moving the form roller 38 bodily in a radial direction relative to an adjacent roller or rollers. Referring back to FIG. 4, pin head 52 is mounted on a shaft 100 which extends through shaft housing 46 (FIG. 3) to rotatably mount the pin head relative to the machine framework. Phantom lines 102 have been drawn outwardly from the axis of rotation of shaft 100 and the center of bearing 42 (i.e. the axis of rotation of shaft end 40). It can be seen by arrows "D" that these axes are offset relative to one another. Therefore, if pin head 52 is rotated about its axis, the entire form roller 38 will be moved in an arc. By properly angularly locating pin head 52, this movement of the form roller is effective to move the roller away from or relative to an adjacent roller or rollers. For instance, this would be desirable as a "night latch" feature or an on-off mechanism in order to separate the adjacent rollers or to remove the pressure therebetween during an extended down time of the machine.

Figure 8:
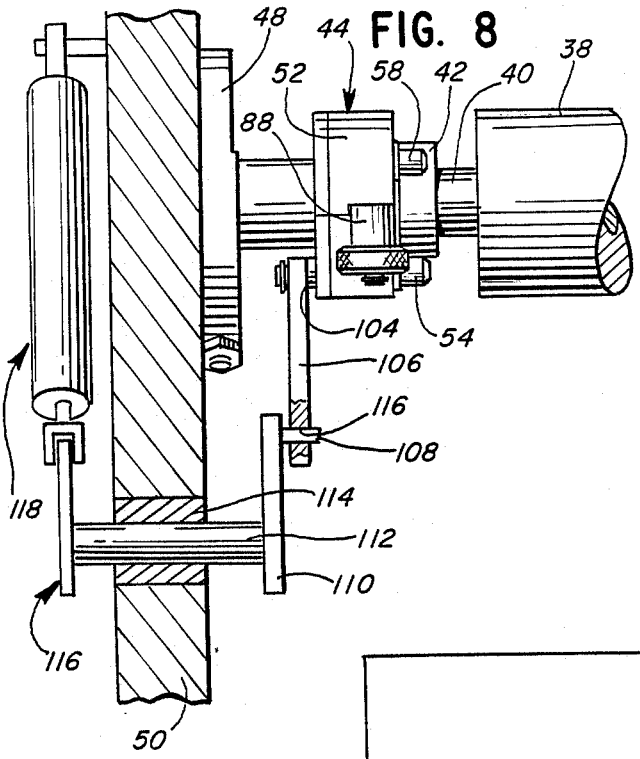
FIG. 8 is a fragmented elevational view of the left-hand end of a distribution roller and its associated bracket assembly, and illustrating a "night latch" mechanism mounted on the machine framework.
Figure 7:
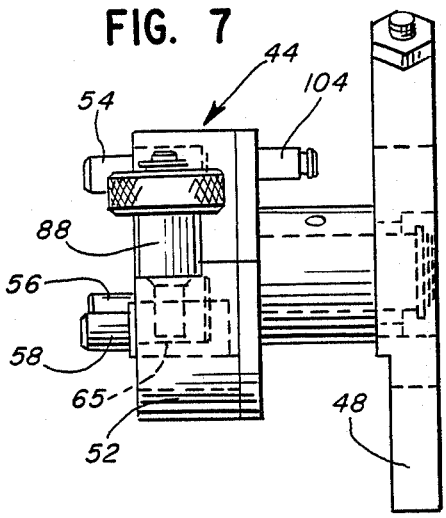
FIG. 7 is a side elevational view of the bracket assembly.
Figure 9:
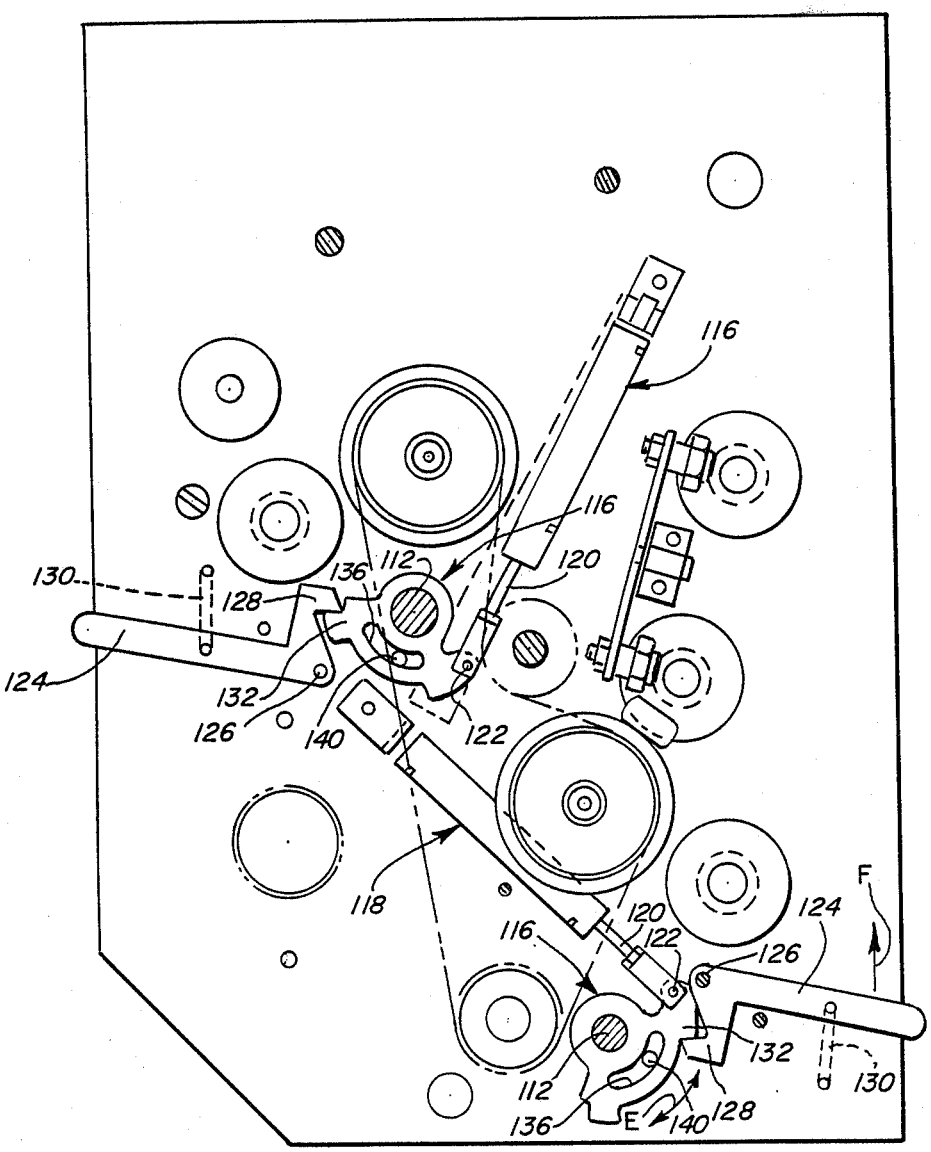
FIG. 9 is an elevational view, on a reduced scale, of a pair of night latch mechanisms mounted on the outside of a side frame plate of the machine.

FIGS. 8 and 9 show a "night latch" or on-off mechanism for effectively rotating the entire bracket assembly 44, including pin head 52 and pins 54–58. Actually, two night mechanisms are shown but will be described below in the singular sense. More particularly, a stub shaft 104 projects from pin head 52 toward machine frame plate 50, as best seen in FIG. 8. A lever arm 106 projects radially outwardly from stub shaft 104. The lever arm is connected by a pivot pin 108 to a second lever arm 110. Lever arm 110 is fixed to a shaft 112 which projects outwardly through a bushing 114 through frame plate 50. Therefore, by providing sufficient play within a bore 116 in lever arm 106 which receives pin 108, rotation of lever arm 110 effectively rotates lever arm 106 which, in turn, rotates bracket assembly 44 through pin head 56.

Referring to FIG. 9 in conjunction with FIG. 8, shaft 112 has a cam member, generally designated 116, fixed thereto on the outside of machine frame plate 52. A piston and cylinder device, generally designated 118, has a piston shaft 120 secured to cam member 116, as at 122. Therefore, actuation of piston and cylinder device 18 is effective to rotate cam member 116 in the direction of double-headed arrow "E". Rotation of the cam member effectively rotates shaft 112 to rotate the bracket assembly. Piston and cylinder device 18 preferably is of a doubleacting type for rotating shaft 112 and the bracket assembly in either direction. In order to lock the mechanism in a position whereby the form roller is maintained out of engagement with an adjacent roller or rollers, a latch lever 124 is pivotally mounted on frame plate 50, as at 126. The latch lever includes a hook portion 128 which is biased by a spring 130 into engagement behind a shoulder 132 of cam member 116. Therefore, in the position shown in FIG. 9, the mechanism is locked in an intermedate, latched or "off" position. In this position, the form roller 38 is latched out of contact with cylinder 26 but in contact with an adjacent oscillating roller 134 (FIG. 2). Manually moving lever 124 in the direction of arrow "F" moves hook 128 out of engagement with shoulder 132. When unlatched, extension of piston 120 rotates cam member 116 to one limit position defined by a slot 136 and a pin 140 to effect separation of form roller 38 from both cylinder 26 and oscillating roller 134. This would be a "night latch" position. Retraction of piston 120 rotates cam member 116 to an opposite limit position defined by slot 136 to effect engagement of form roller 38 with both cylinder 26 and oscillating roller 134, in an "on" position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A bracket assembly for receiving and positionally adjusting the shaft end of a distribution roller in a printing, duplicating or like machine, comprising:

a pin head structure mounted on a framework of the machine;

a triangular array of pins projecting inwardly of the pin head axially of the roller for receiving the shaft end of the roller in a position of engagement between the sides of the pins and the sides of the shaft end;

means for adjusting at least one of said pins generally in a radial direction to take up any radial play between the roller shaft end and the pin array;

means for adjusting at least one of said pins in an axial direction to take up any axial play between the roller shaft end and the pin head structure; and means for retracting at least one of said pins to allow for insertion of the roller into position between the pins.

2. The bracket assembly of claim 1 wherein said radial adjusting means include means rotatably mounting said one pin eccentric to its axis of rotation for radially moving the pin in response to rotation thereof.

3. The bracket assembly of claim 2, including means for locking said one pin in any rotatable position of adjustment.

4. The bracket assembly of claim 1 wherein said axial adjusting means include axial bore means in the pin head for freely receiving said one pin, and means for holding the pin in any axial position in the bore.

5. The bracket assembly of claim 4 wherein said one pin includes shoulder means for axially engaging the roller shaft end.

6. The bracket assembly of claim 4 wherein said holding means include a set screw threaded into the pin head for engaging the one pin in a reduced diameter area of the pin.

7. The bracket assembly of claim 1 wherein said retracting means include means for moving said one pin axially into the pin head to free a path for inserting the roller shaft end radially between the array of pins.

8. The bracket assembly of claim 7 wherein said retracting means include a lock bolt in the pin head and engageable with the one pin for moving the one pin into and out of the pin head.

9. The bracket assembly of claim 8, including releasable latch means for holding the lock bolt and pin in extended position and for allowing movement of the one pin into and out of the pin head.

10. The bracket assembly of claim 1, including means movably mounting the entire pin head structure on the framework of the machine for moving the distribution roller bodily in a radial direction relative to an adjacent roller.

11. The bracket assembly of claim 10 wherein said pin head structure is mounted on the machine framework for rotation about a given axis generally parallel to and offset from the axis of rotation of the distribution roller to effect said radial movement of the roller in response to rotation of the pin head structure.

12. The bracket assembly of claim 11, including latch means extending from the outside of the machine framework, through the framework, for rotating the pin head structure.

13. A bracket assembly for receiving and positionally adjusting the shaft end of a distribution roller in a printing, duplicating or like machine, comprising:

receptacle means for receiving and engaging the shaft end of the distribution roller in at least three radial directions and positioning the shaft end;

means for adjusting at least a portion of the receptacle means in a radial direction to take up any radial play between the roller shaft end the receptacle means;

means for adjusting at least a portion of the receptacle means in an axial direction to take up any axial play between the roller shaft end and the recpetacle means; and means for retracting at least a portion of the receptacle means to allow for insertion of the roller into position in the receptacle means.

14. The bracket assembly of claim 13 wherein said receptacle means comprises three pins in a triangular array and projecting inwardly of the pin head axially of the roller for embracing the shaft end of the roller in a position of engagement between the pins.

15. The bracket assembly of claim 14 wherein one of said pins is adjustable generally in a radial direction relative to the roller to take up any radial play between the roller end and the pin array.

16. The bracket assembly of claim 15 wherein a second of said pins is adjustable in an axial direction to take up any axial play between the roller shaft end and the receptacle means.

17. The bracket assembly of claim 16 wherein a third of said pins is axially retractable to allow for insertion of the roller into position between the pins.

18. The roller assembly of claim 13, wherein said receptacle means is mounted on the machine framework for rotation about a given axis generally parallel to and offset from the axis of rotation of the distribution roller to effect radial movement of the roller bodily in response to rotation of the receptacle means.

* * * * *